US008702077B2

(12) United States Patent
Liu

(10) Patent No.: US 8,702,077 B2
(45) Date of Patent: Apr. 22, 2014

(54) QUICK CLAMP

(76) Inventor: Sung Chi Liu, Taichung (TW)

( * ) Notice: Subject to any disclaimer, the term of this patent is extended or adjusted under 35 U.S.C. 154(b) by 16 days.

(21) Appl. No.: 13/590,349

(22) Filed: Aug. 21, 2012

(65) Prior Publication Data

US 2013/0099437 A1 Apr. 25, 2013

(30) Foreign Application Priority Data

Oct. 19, 2011 (TW) ..... 100219540 U

(51) Int. Cl.
*B25B 1/00* (2006.01)
*B25B 1/02* (2006.01)
*B25B 5/02* (2006.01)

(52) U.S. Cl.
USPC ..... 269/6; 269/3; 269/165

(58) Field of Classification Search
USPC ..... 269/3, 6, 97, 42, 165; D8/72, 73
See application file for complete search history.

(56) References Cited

U.S. PATENT DOCUMENTS

| | | | | |
|---|---|---|---|---|
| D482,585 | S * | 11/2003 | Brass et al. | D8/72 |
| 6,655,670 | B1 * | 12/2003 | Liou | 269/6 |
| 6,913,234 | B2 * | 7/2005 | Weiss | 248/231.71 |
| D543,821 | S * | 6/2007 | Ranieri | D8/73 |
| 8,322,697 | B2 * | 12/2012 | Lin | 269/42 |
| 8,544,831 | B2 * | 10/2013 | Klein et al. | 269/165 |
| 2003/0234479 | A1 * | 12/2003 | Brass et al. | 269/97 |
| 2007/0222130 | A1 * | 9/2007 | Leinbach et al. | 269/6 |
| 2011/0095463 | A1 * | 4/2011 | Eberle, III | 269/6 |
| 2012/0193853 | A1 * | 8/2012 | Patel et al. | 269/6 |

* cited by examiner

*Primary Examiner* — Alvin Grant
(74) *Attorney, Agent, or Firm* — Bacon & Thomas, PLLC

(57) ABSTRACT

A quick clamp includes a first jaw, a second jaw, a crank, an operating handle, a shaft assembly and a slide rail. The crank is arranged in a cover plate of the second jaw with the operating handle rotatably screwed to an upper end of the crank, the shaft assembly connected to a through bore formed at a middle portion of the crank and the slide rail extended through a slide rail slot formed near a lower end of the crank. By turning the operating handle in one direction, the crank is brought to pivot with the slide rail slot thereof becoming inclined to press against the slide rail, so that the slide rail is stopped from moving relative to the second jaw. When the operating handle is turned reversely, the slide rail is released, and the second jaw is movable along the slide rail.

4 Claims, 6 Drawing Sheets

QUICK CLAMP

FIELD OF THE INVENTION

The present invention relates to a quick clamp, and more particularly to a quick clamp that includes a crank arranged in a jaw and an operating handle being turnable to pivot the crank between an upright and an inclined position, so that the crank in the inclined position stops a slide rail of the quick clamp from moving relative to the jaw and the crank in the upright position releases the slide rail.

BACKGROUND OF THE INVENTION

FIG. 8 shows a conventional woodworking clamp, of which a movable jaw C is fixedly mounted to an end of a gauge rod D, which is movable by operating a trigger A. When the trigger A is pulled to turn about a pivot point thereof, a stop plate E provided immediately behind the trigger A is brought into an inclined position, such that a through slot B provided on the stop plate E, through which the gauge rod D is extended, also becomes inclined relative to the gauge rod D to tightly press against and thereby push the gauge rod D to move, so that the movable jaw C fixedly mounted on the gauge rod D is moved to a desired position. The above-structured conventional woodworking clamp is disadvantageous for use because a user must exert efforts to pull the trigger A with fingers so that the shift plate E can be inclined for the through slot B to frictionally contact with and push the gauge rod D to move, and the user's fingers would become sore and uncomfortable after continuously operating the trigger A several times.

It is therefore tried by the inventor to develop an improved quick clamp to overcome the disadvantage of the conventional woodworking clamp.

SUMMARY OF THE INVENTION

A primary object of the present invention is to eliminate the drawback of the conventional woodworking clamp by providing a quick clamp, which has simple structure and requires only one simple and effortless turning movement at a handle thereof to quickly stop or release a slide rail thereof, so that a user would not have a sore and uncomfortable hand even after continuously operating the quick clamp several times.

To achieve the above and other objects, the quick clamp according to the present invention includes a first jaw, a second jaw, a crank, an operating handle, a shaft assembly and a slide rail. The first jaw and the second jaw are correspondingly provided near a lower edge with a first and a second slot that transversely extend through the first and the second jaw, respectively, and the slide rail is extended through the second slot into the first slot to lock to the first jaw while the second jaw is fitted around the slide rail. The second jaw includes a cover plate and a base plate, which are closed to each other and assembled to a space defined on one side of the second jaw facing away from the first jaw and then locked together using screws. The base plate is internally provided near an upper portion with a guide way and at a lateral middle portion with a recess. The crank is provided at an upper end with an internally threaded transverse sleeve portion, at a middle portion with a transverse through bore, and near a lower end with a transverse slide rail slot. The crank is arranged in the base plate of the second jaw with the operating handle rotatably assembled to the upper internally threaded sleeve portion, the shaft assembly connected to the middle through bore and the slide rail extended through the lower slide rail slot. The operating handle includes a shank, which has a length formed into a screw rod portion and has a wheel-like free end. The shank of the operating handle is screwed through the upper internally threaded sleeve portion of the crank with the wheel-like free end rotatably received in the guide way formed on the inner upper portion of the base plate. The shaft assembly includes a shaft body, a compression spring, a washer, and a nut; and the shaft body has a diametrically expanded front end and an externally threaded rear end. The shaft assembly is connected to the crank by rearwardly extending the externally threaded rear end of the shaft body through the middle through bore of the crank, putting the compression spring around the shaft body, placing the washer around the shaft body to abut it on a rear end of the compression spring, and tightening the nut to the externally threaded rear end of the shaft body. The shaft assembly is connected to the crank with the expanded front end of the shaft body received in the recess formed on the inner middle portion of the base plate, such that the expanded front end of the shaft body of the shaft assembly received in the recess formed on the inner middle portion of the base plate forms a fulcrum of the crank. The slide rail is sequentially extended through the slide rail slot formed near the lower end of the crank and the second slot formed near the lower edge of the second jaw into the first slot formed near the lower edge of the first jaw.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

Figure 1:
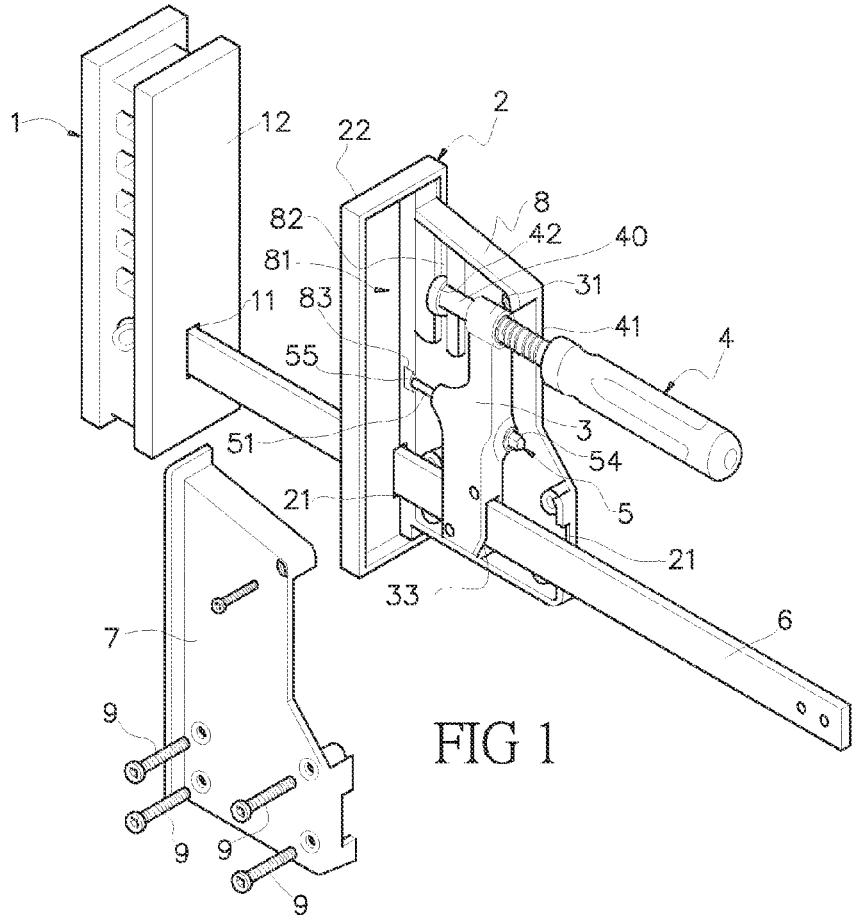
FIG. 1 is an exploded perspective view of a quick clamp according to a preferred embodiment of the present invention.
Figure 2:
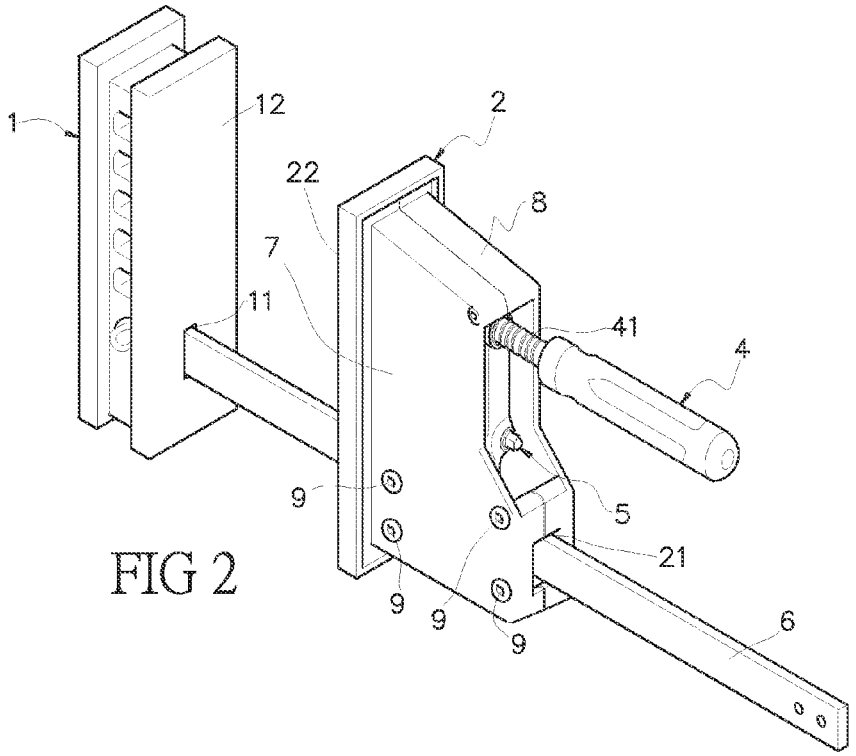
FIG. 2 is an assembled view of FIG. 1.

The present invention will now be described with a preferred embodiment thereof and with reference to the accompanying drawings. Please refer to FIGS. 1, 2 and 3. A quick clamp according to the preferred embodiment of the present invention includes a first jaw 1, a second jaw 2, a crank 3, an operating handle 4, a shaft assembly 5, and a slide rail 6.

The first and the second jaw 1, 2 are correspondingly provided near a lower edge thereof with a first and a second slot 11, 21 that transversely extend through the first and the second jaw 1, 2, respectively. The slide rail 6 is extended through the second slot 21 into the first slot 11, such that a first clamping face 12 located at an inner side of the first jaw 1 and a second clamping face 22 located at an inner side of the second jaw 2 are oriented to each other. The first jaw 1 is immovably locked to a front end of the slide rail 6, while the second jaw 2 is fitted around the slide rail 6 and can be slid along an upper and a lower edge of the slide rail 6 toward or away from the first jaw 1. The second jaw 2 includes a cover plate 7 and a base plate 8 closed to each other and assembled to the second clamping face 22. More specifically, one side of the second clamping face 22 facing away from the first jaw 1 defines a space 81, to which the cover plate 7 and the base plate 8 are assembled and then locked together using screws 9. The base plate 8 is internally provided near an upper portion with a guide way 82, and at a lateral middle portion with a recess 83.

The crank 3 is provided at an upper end with an internally threaded transverse sleeve portion 31, at a middle portion with a transverse through bore 32, and near a lower end with a transverse slide rail slot 33. The crank 3 is arranged in the base plate 8 of the second jaw 2 with the operating handle 4 rotatably assembled to the upper internally threaded sleeve portion 31, the shaft assembly 5 connected to the middle through bore 32, and the slide rail 6 extended through the lower slide rail slot 33.

The operating handle 4 includes a shank 40, which has a length formed into a screw rod portion 41 and has a wheel-like free end 42. The shank 40 of the operating handle 40 is screwed through the upper internally threaded sleeve portion 31 of the crank 3 with the wheel-like free end 42 rotatably received in the guide way 82 formed on the inner upper portion of the base plate 8.

The shaft assembly 5 includes a shaft body 51, a compression spring 52, a washer 53, and a nut 54. The shaft body 51 has a diametrically expanded front end 55 and an externally threaded rear end. To connect the shaft assembly 5 to the crank 3, first rearwardly extend the externally threaded rear end of the shaft body 51 through the middle through bore 32 of the crank 3, and then put the compression spring 52 around the shaft body 51 before placing the washer around the shaft body 51 to abut it on a rear end of the compression spring 51. Finally, tighten the nut 54 to the externally threaded rear end of the shaft body 51. After the shaft assembly 5 is connected to the crank 3, further put the expanded front end 55 of the shaft body 51 in the recess 83 formed on the inner middle portion of the base plate 8. In this manner, the expanded front end 55 of the shaft body 51 of the shaft assembly 5 received in the recess 83 formed on the inner middle portion of the base plate 8 forms a fulcrum of the crank 3.

To assemble the slide rail 6 to the first and the second jaw 1, 2, simply sequentially extend the slide rail 6 through the slide rail slot 33 formed near the lower end of the crank 3 and the second slot 21 formed near the lower edge of the second jaw 2 into the first slot 11 formed near the lower edge of the first jaw 1, and lock the front end of the slide rail 6 to the first jaw 1.

Figure 4:
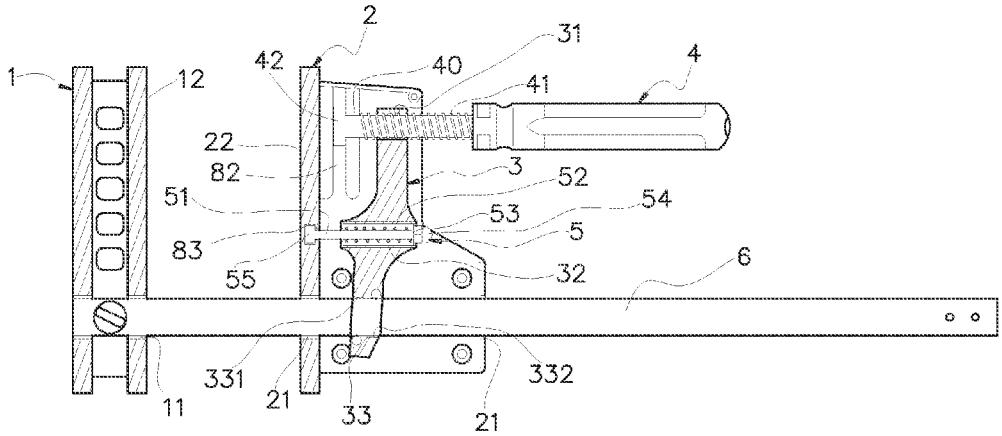
FIG. 4 is a sectional side view showing a crank of the quick clamp of the present invention in an inclined position.
Figure 5:
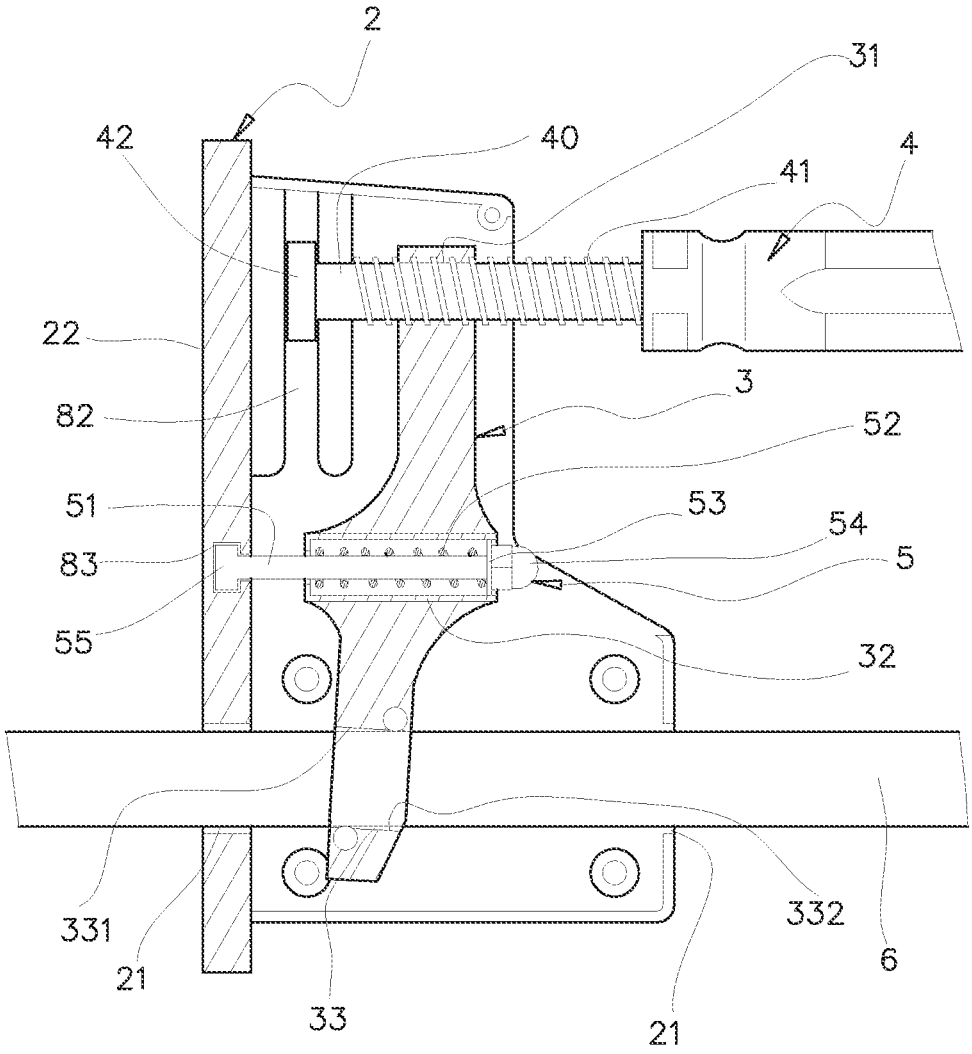
FIG. 5 is a partial and enlarged view of FIG. 4.

The operating manner of the quick clamp fully assembled from the first jaw 1, the second jaw 2, the crank 3, the operating handle 4, the shaft assembly 5 and the slide rail 6 is described below. When a user turns the operating handle 4 clockwise, the screw rod portion 41 of the operating handle 4 is caused to move forward, as shown in FIG. 4. At this point, the wheel-like front end 42 of the shank 40 of the operating handle 4 rotatably received in the guide way 82 produces a reaction force against the internally threaded sleeve portion 31 at the upper end of the crank 3, bringing the sleeve portion 31 to shift rearward (i.e. to move toward the right side in the drawing). Meanwhile, the compression spring 52 fitted in the through bore 32 at the middle portion of the crank 3 is compressed and the crank 3 pivots about the expanded front end 55 of the shaft body 51, so that the lower end of the crank 3 is shifted forward and upward. With the lower end of the crank 3 in the forward and upward shifted position, an upper wall surface 331 and a lower wall surface 332 of the slide rail slot 33 formed near the lower end of the crank 3 become inclined relative to the slide rail 6 to press against the upper edge and the lower edge of the slide rail 6, respectively, and accordingly stop the slide rail 6 from moving, as can be more clearly seen in FIG. 5.

Figure 3:
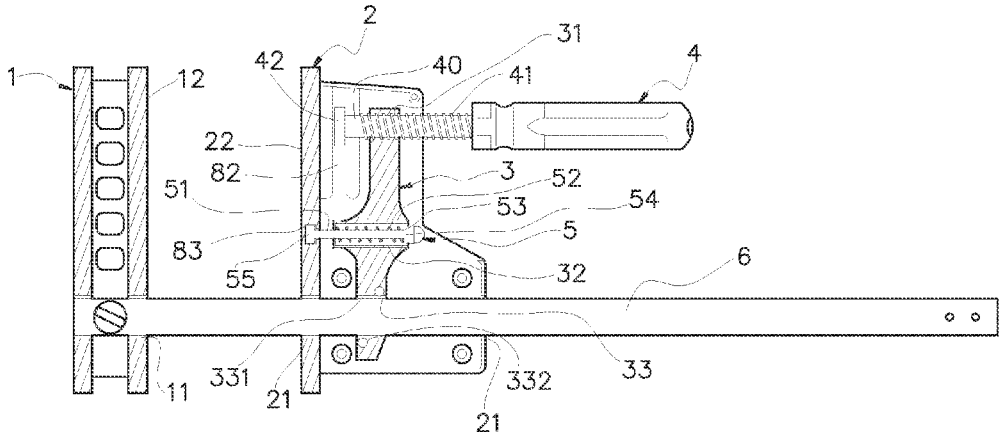
FIG. 3 is a sectional side view of FIG. 2.
Figure 6:
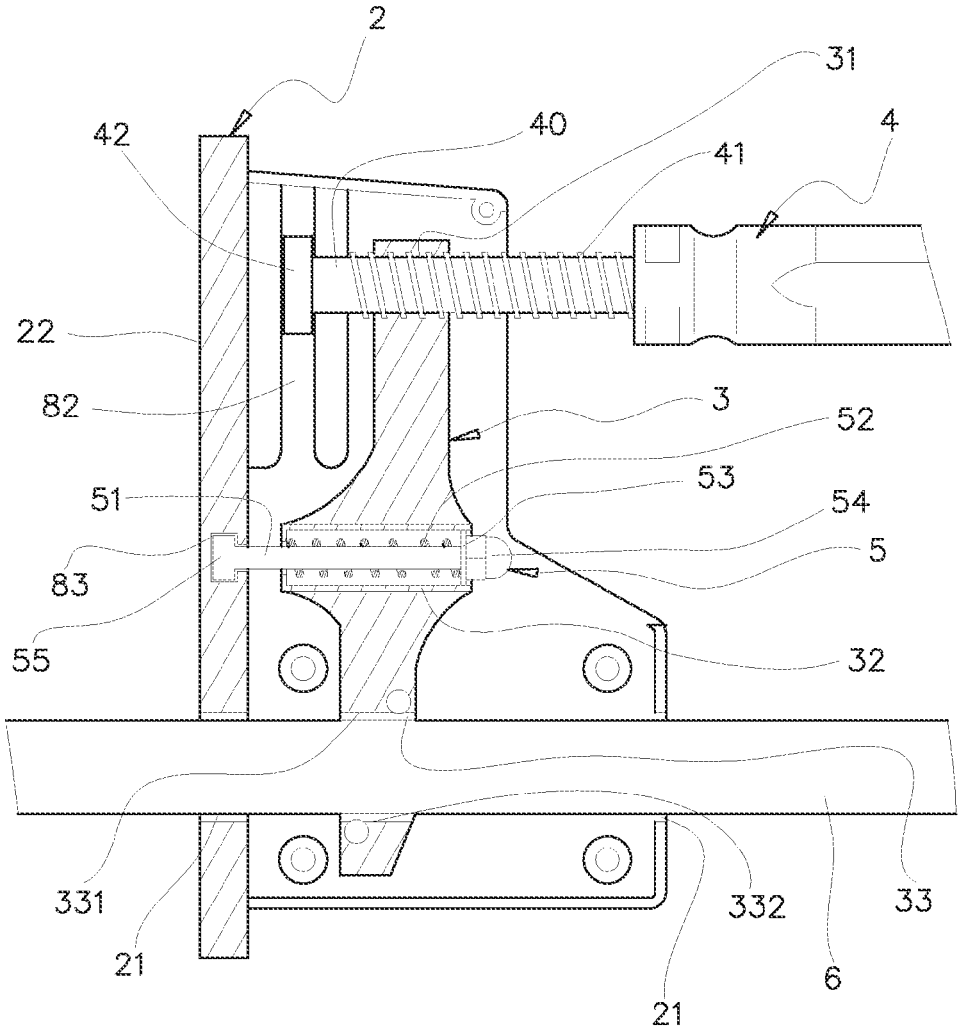
FIG. 6 is a partial and enlarged view of FIG. 3.

On the other hand, when the user turns the operating handle 4 counterclockwise, the screw rod portion 41 of the operating handle 4 is caused to move backward, as shown in FIG. 3. Meanwhile, the compression spring 52 fitted in the through bore 32 at the middle portion of the crank 3 is not longer compressed and elastically restores to its original state, and the lower end of the crank 3 is shifted back to an original upright position. With the lower end of the crank 3 located in the upright position, the upper wall surface 331 and the lower wall surface 332 of the slide rail slot 33 formed near the lower end of the crank 3 become parallel to the upper edge and the lower edge of the slide rail 6, respectively, and accordingly release the slide rail 6 from the immovable state, as shown in FIG. 6.

Figure 7:
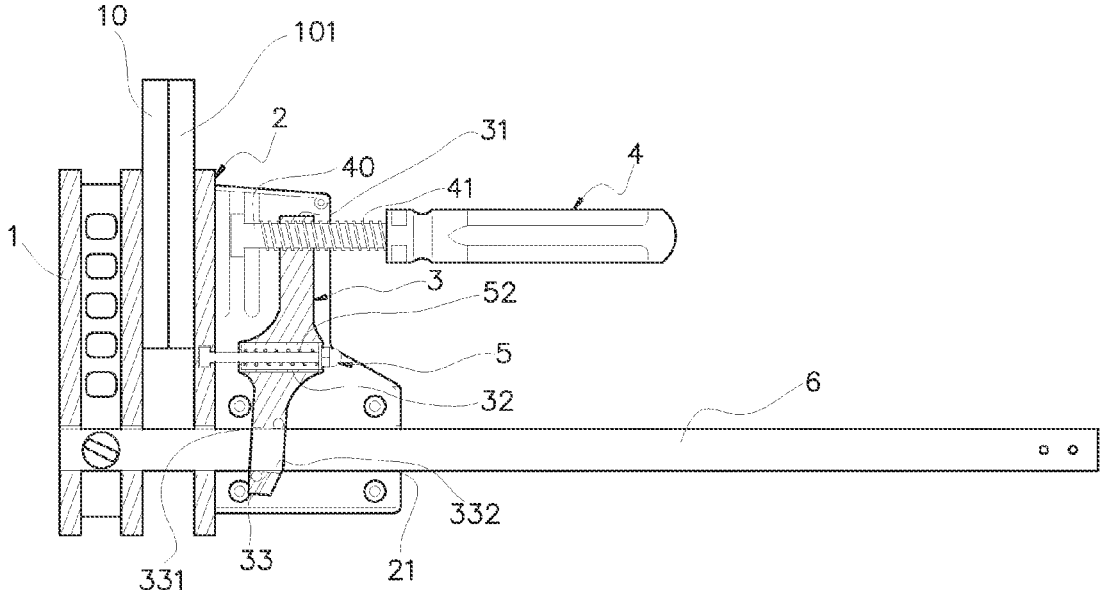
FIG. 7 is a sectional side view showing the quick clamp of the present invention clamps two workpieces together.
Figure 8:
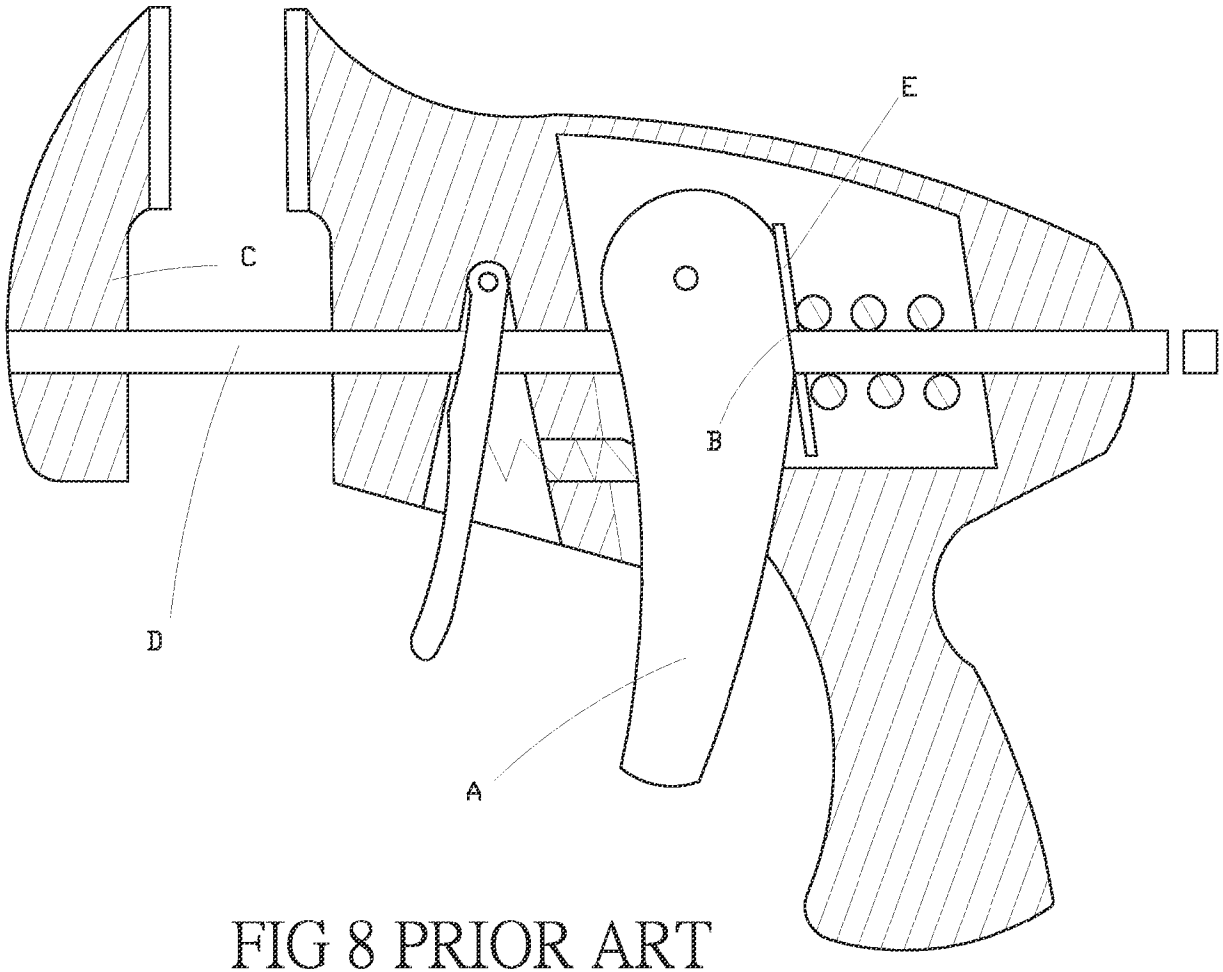
FIG 8 PRIOR ART
FIG. 8 is a sectional side view of a conventional woodworking clamp.

With the structural design of the present invention, the user can quickly stop or release the slide rail 6 relative to the second jaw 2 simply by turning the operating handle 4, making it very easy to clamp two wood workpieces 10, 101 together for further machining, as shown in FIG. 7.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A quick clamp, comprising a first jaw, a second jaw, a slide rail, a crank, an operating handle, and a shaft assembly;

the first jaw and the second jaw being correspondingly provided near a lower edge thereof with a first and a second slot that transversely extend through the first and the second jaw, respectively; the slide rail being extended through the second slot into the first slot, such that a first clamping face located at an inner side of the first jaw and a second clamping face located at an inner side of the second jaw are oriented to each other; the first jaw being immovably locked to a front end of the slide rail while the second jaw being fitted around the slide rail and slidable along an upper and a lower edge of the slide rail toward or away from the first jaw; the second jaw including a cover plate and a base plate, which are closed to each other and assembled to a space defined on one side of the second clamping face facing away from the first jaw before being locked together using screws; and the base plate being internally provided near an upper portion with a guide way and at a lateral middle portion with a recess;

the crank being provided at an upper end with an internally threaded transverse sleeve portion, at a middle portion with a transverse through bore, and near a lower end with a transverse slide rail slot; and the crank being arranged in the base plate of the second jaw with the operating handle rotatably assembled to the upper internally threaded sleeve portion, the shaft assembly connected to the middle through bore and the slide rail extended through the lower slide rail slot;

the operating handle including a shank, which has a length formed into a screw rod portion and has a wheel-like free end; and the shaft assembly including a shaft body, a compression spring, a washer, and a nut; and the shaft body having a diametrically expanded front end and an externally threaded rear end.

2. The quick clamp as claimed in claim 1, wherein the shank of the operating handle is screwed through the upper internally threaded sleeve portion of the crank with the wheel-like free end rotatably received in the guide way formed on the inner upper portion of the base plate.

3. The quick clamp as claimed in claim 1, wherein the shaft assembly is connected to the crank by rearwardly extending the externally threaded rear end of the shaft body through the middle through bore of the crank, putting the compression spring around the shaft body, placing the washer around the shaft body to abut the rear end of the compression spring, and tightening the nut to the externally threaded rear end of the shaft body.

4. The quick clamp as claimed in claim 1, wherein the shaft assembly is connected to the crank with the expanded front end of the shaft body received in the recess formed on the inner middle portion of the base plate, such that the expanded front end of the shaft body of the shaft assembly received in the recess formed on the inner middle portion of the base plate forms a fulcrum of the crank.

* * * * *